US009784057B2

(12) United States Patent
Lloyd et al.

(10) Patent No.: US 9,784,057 B2
(45) Date of Patent: Oct. 10, 2017

(54) MECHANICAL BI-DIRECTIONAL ISOLATION VALVE

(75) Inventors: Sam S. Lloyd, Houston, TX (US); Michael R. Reaves, Tomball, TX (US); Don C. Gramlich, Conroe, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 262 days.

(21) Appl. No.: 12/112,092

(22) Filed: Apr. 30, 2008

(65) Prior Publication Data

US 2009/0272539 A1 Nov. 5, 2009

(51) Int. Cl.

| | |
|---|---|
| ***E21B 21/10*** | (2006.01) |
| ***E21B 34/10*** | (2006.01) |
| ***E21B 34/14*** | (2006.01) |
| *E21B 34/00* | (2006.01) |

(52) U.S. Cl.

CPC ..... *E21B 21/10* (2013.01); *E21B 34/102* (2013.01); *E21B 34/14* (2013.01); *E21B 2034/005* (2013.01)

(58) Field of Classification Search

CPC ..... E21B 34/14; E21B 34/06; E21B 2034/005
USPC ..... 166/373, 386, 332.4, 332.8; 175/57, 318
See application file for complete search history.

(56) References Cited

U.S. PATENT DOCUMENTS

| | | | | |
|---|---|---|---|---|
| 2,162,578 A | | 5/1937 | Hacker | |
| 2,894,715 A | * | 7/1959 | Bostock | E21B 34/10 166/324 |
| 3,151,839 A | * | 10/1964 | Mott | E21B 34/12 166/334.1 |
| 4,088,298 A | * | 5/1978 | Brown | F16K 15/183 137/68.16 |
| 4,356,867 A | | 11/1982 | Carmody | |
| 4,415,036 A | * | 11/1983 | Carmody | E21B 34/101 137/630.14 |
| 4,574,889 A | | 3/1986 | Pringle | |
| 4,813,481 A | * | 3/1989 | Sproul et al. | 166/51 |
| 4,951,753 A | | 8/1990 | Eriksen | |
| 4,991,654 A | | 2/1991 | Brandell et al. | |
| 5,137,089 A | | 8/1992 | Smith et al. | |
| 5,325,917 A | | 7/1994 | Szarka | |
| 5,479,989 A | | 1/1996 | Shy et al. | |
| 5,564,502 A | | 10/1996 | Crow et al. | |

(Continued)

FOREIGN PATENT DOCUMENTS

| | | |
|---|---|---|
| EP | 0985799 | 3/2000 |
| GB | 2309723 | 8/1997 |
| WO | WO 2007125335 A1 * | 11/2007 |

OTHER PUBLICATIONS

Brian Grayson; "DDV usage reduces time to round-trip drill string cuts costs"; World Oil Magazine; May 2004, 10 pages.

(Continued)

*Primary Examiner* — Shane Bomar
(74) *Attorney, Agent, or Firm* — Patterson & Sheridan, LLP

(57) ABSTRACT

A valve having a sealing surface that is rotated 90 degrees on axial floating hinge assemblies is provided. A sleeve moves into position to protect the valve mechanism when the valve is in an open position. A sleeve locks the valve sealing element in place in either a closed or open position. The valve may be used during drilling of wells to prevent flow into the casing when the drill pipe and bit are raised above the valve.

20 Claims, 14 Drawing Sheets

(56) References Cited

U.S. PATENT DOCUMENTS

| | | | | |
|---|---|---|---|---|
| 5,564,675 | A | 10/1996 | Hill, Jr. et al. | |
| 5,617,918 | A * | 4/1997 | Cooksey et al. | 166/115 |
| 6,059,041 | A | 5/2000 | Scott | |
| 6,079,497 | A | 6/2000 | Johnston | |
| 6,167,974 | B1 | 1/2001 | Webb | |
| 6,209,663 | B1 | 4/2001 | Hosie | |
| 6,230,808 | B1 * | 5/2001 | French et al. | 166/323 |
| 6,308,783 | B2 | 10/2001 | Pringle et al. | |
| 6,328,109 | B1 * | 12/2001 | Pringle et al. | 166/373 |
| 6,343,658 | B2 * | 2/2002 | Webb | 166/386 |
| 6,494,269 | B2 * | 12/2002 | French et al. | 166/386 |
| 6,508,309 | B1 * | 1/2003 | French | E21B 21/00 166/323 |
| 6,904,975 | B2 * | 6/2005 | Horne et al. | 166/386 |
| 7,137,452 | B2 | 11/2006 | McVicker | |
| 7,451,809 | B2 | 11/2008 | Noske et al. | |
| 7,597,151 | B2 | 10/2009 | Curtis et al. | |
| 7,673,689 | B2 * | 3/2010 | Jackson et al. | 166/332.8 |
| 7,762,336 | B2 * | 7/2010 | Johnson et al. | 166/373 |
| 7,789,156 | B2 | 9/2010 | Pia | |
| 8,006,772 | B2 * | 8/2011 | Nazir et al. | 166/386 |
| 8,066,075 | B2 | 11/2011 | Cowie et al. | |
| 8,191,570 | B2 * | 6/2012 | Purkis | 137/493.9 |
| 2001/0007284 | A1 * | 7/2001 | French et al. | 166/373 |
| 2002/0007950 | A1 * | 1/2002 | Simpson et al. | 166/332.2 |
| 2003/0173091 | A1 * | 9/2003 | Horne et al. | 166/386 |
| 2005/0230151 | A1 | 10/2005 | McGarian et al. | |
| 2006/0151177 | A1 * | 7/2006 | Williams et al. | 166/363 |
| 2007/0151736 | A1 | 7/2007 | Du et al. | |
| 2007/0215361 | A1 | 9/2007 | Pia | |
| 2007/0284119 | A1 * | 12/2007 | Jackson et al. | 166/386 |
| 2008/0245531 | A1 * | 10/2008 | Noske | E21B 21/08 166/373 |
| 2009/0229829 | A1 | 9/2009 | Lloyd et al. | |
| 2009/0230340 | A1 * | 9/2009 | Purkis | 251/228 |
| 2009/0255685 | A1 * | 10/2009 | Nazir et al. | 166/373 |

OTHER PUBLICATIONS

Bob Knoll; "MPD well taps light oil in deep Monterey Shale"; World Oil Magazine; May 2005; 6 pages.

Electric Flow Controls; Hydraulic Control Systems for Downhole Deployment Valve; 2 pages.

Steve Herbal et al; Society of Petroleum Engineers—IADC/SPE 77240; "Downhole Deployment Valve Addresses Problems Associated with Tripping Drill Pipe During Underbalanced Drilling Operations";Sep. 2002; pp. 1-5.

Don Hannegan; Society of Petroleum Engineers—SPE 112803; "Managed Pressure Drilling"; 2007.

European Patent Office; Correspondence dated Jul. 21, 2011; pp. 1-7.

Australian Government; Correspondence dated Jul. 28, 2011; pp. 1-3.

* cited by examiner

MECHANICAL BI-DIRECTIONAL ISOLATION VALVE

BACKGROUND OF THE INVENTION

1. Field of the Invention

This invention relates to an apparatus that may be used in wells during drilling operations. More particularly, a valve having a full-opening bore that may be placed in a tubular such as casing and operated mechanically to isolate pressure when it is closed is provided.

2. Description of Related Art

Drilling of wells in an underbalanced or balanced pressure condition has well-known advantages. In this condition, pressure in the formation being drilled is equal to or greater than pressure in the wellbore. When there is a need to withdraw the drill pipe from the well, pressure in the wellbore must be controlled to prevent influx of fluids from a formation into the wellbore. The usual remedy of preventing influx of fluid from a formation—by increasing fluid density in the wellbore—may negate the advantages of balanced or underbalanced drilling. Therefore, downhole valves have been developed to isolate fluid pressure below the valve. They have been variously called "Downhole Deployment Valves" (DDV) or "Downhole Isolation Valves" (DIV). Technical literature includes reports of the usage of such valves in Under-Balanced Drilling (UBD) For example, SPE 77240-MS, "Downhole Deployment Valve Addresses Problems Associated with Tripping Drill Pipe During Underbalanced Drilling Operations," S. Herbal et al, 2002, described uses of such valves in industry. The DDV or DIV as a tool in the broad area of "Managed Pressure Drilling" can be generally surmised from the survey lecture "Managed Pressure Drilling," by D. Hannagan, SPE 112803, 2007. There it is listed under "Other Tools" and called a "Downhole Casing Isolation Valve" (DCIV) or "Downhole Deployment Valve." Services and products for providing Managed Pressure Drilling have been commercialized by AtBalance of Houston, Tex., Weatherford International, Inc. of Houston, Tex. and other companies.

A DCIV is placed in a casing at a selected depth, considering conditions that may be encountered in drilling the well. The valve is normally placed in an intermediate casing string, and the effective Outside Diameter (OD) of the valve is limited by the Inside Diameter (ID) of the surface casing through which it must pass. For example, in 9⅝-inch intermediate casing, the valve preferably will be full-opening (have a bore at least equal to the ID of the 9⅝ inch casing, about 8.681 inches, or at least be as large as the drill bit to be used) and must pass through the drift diameter of the surface casing, which may be 10.5 inches. Therefore, the valve must be designed to severely limit the thickness of the valve body while being large enough for a bit to pass through.

A DCIV is disclosed in U.S. Pat. No. 6,209,663. A flapper valve is illustrated, but other types of valves, such as ball valves or other rotary valves are disclosed. The valves may be mechanically operated or operated by biasing means (e.g., springs). U.S. Pat. No. 6,167,974 discloses a flapper-type DCIV valve that is operated by a shifting device that is carried on a drill bit and deposited in the valve when the drill string is tripped out of the well.

Prior art valves relying on a flapper mechanism have been commercially successful, but improvements in reliability and absence of leakage are needed. A rotary valve having minimum difference between outside diameter and inside diameter is needed. The ability of the valve to seal with differential pressure in two directions is also preferred.

It should be understood that valves designed for downhole isolation may also be used for a variety of purposes. In wells, there may be a need to open or close a valve to control pressure near the bottom of the well when the hydrostatic pressure of fluid in the well is higher than desired, or there may be a need to isolate pressure in a well bore drilled from another well bore. In industry, valves requiring a minimum of wall thickness between the interior passage through the valve and the exterior surface of the valve may be needed for a variety of applications in any industry utilizing mechanical techniques.

SUMMARY OF INVENTION

A mechanically activated, bi-directional (will isolate fluid pressure in either direction) valve is disclosed, referred to herein as the Mechanical Bi-directional Isolation Valve (MBIV). The valve element is mounted on a hinge plate assembly. As a protective sleeve exposes the "Wedgelock" (sealing element having curved surfaces), the hinge plate assembly will move the valve into the closed position. When the protective sleeve moves in the opposite direction, the hinge plate assembly will move the Wedgelock into the open position. After closing, the valve is locked into position by a locking sleeve to isolate fluid pressure differential across the valve in either direction.

DETAILED DESCRIPTION

Figure 1:
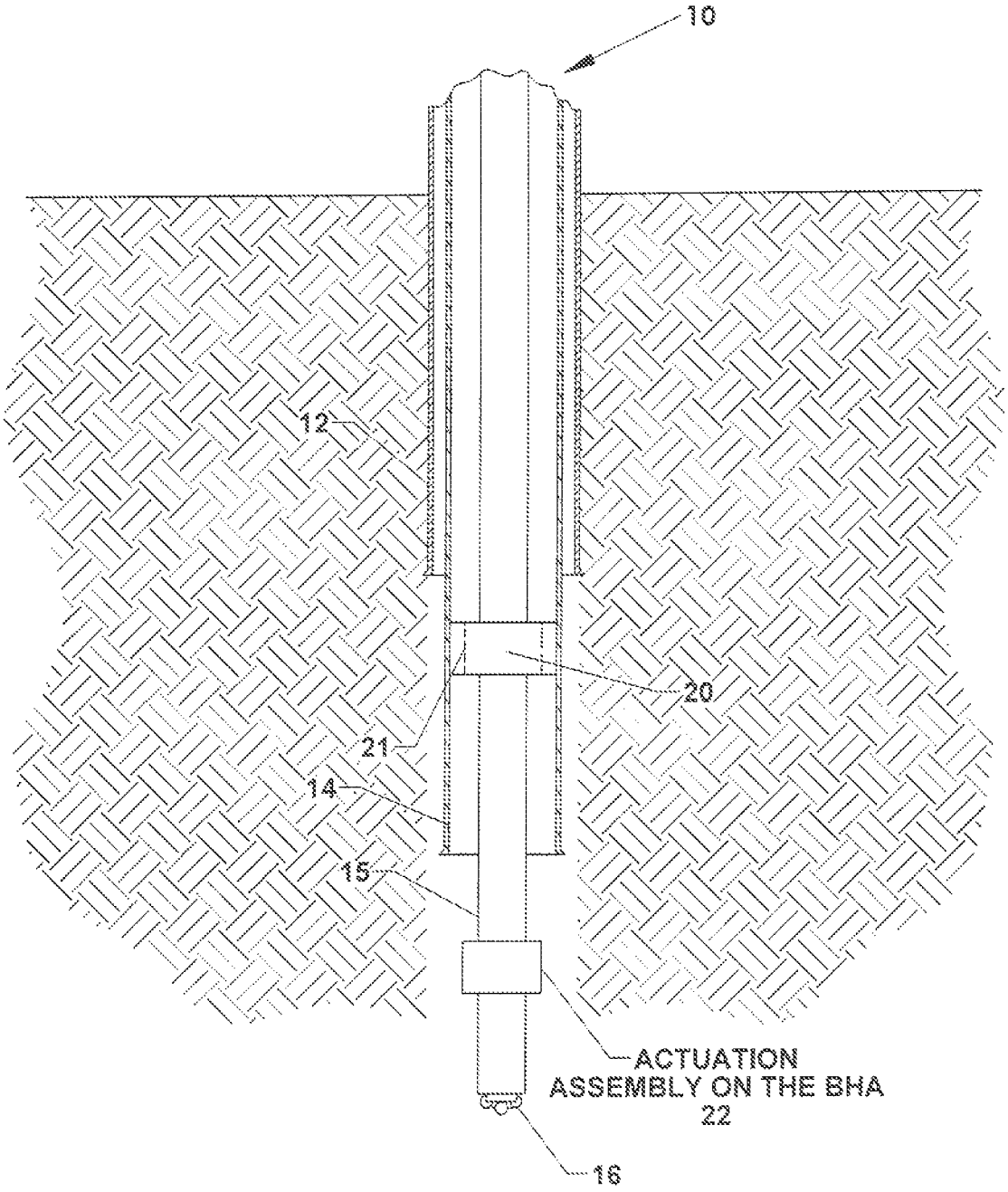
FIG. 1 is a sketch of a well having an MBIV in an intermediate casing.

FIG. 1 illustrates well 10 that is being drilled. As an example, surface casing 12 has been placed in the well.

Intermediate casing 14, containing the MBIV 20, used as a downhole casing isolation valve, has also been placed in the well. Inside diameter 21 of the MBIV 20 must be large enough to allow passage of drill bit 16 on the drill pipe 15. The MBIV 20 disclosed here is adapted to allow a lesser difference in diameter between the inside diameter 21 of MBIV 20 and the inside diameter of intermediate casing 14 than is allowed by downhole isolation valves cited in the references disclosed above. MBIV 20 is mechanically actuated by actuation assembly on the BHA 22 as drill bit 16 and drill pipe 15 travel in and out of the well 10.

Figure 2:
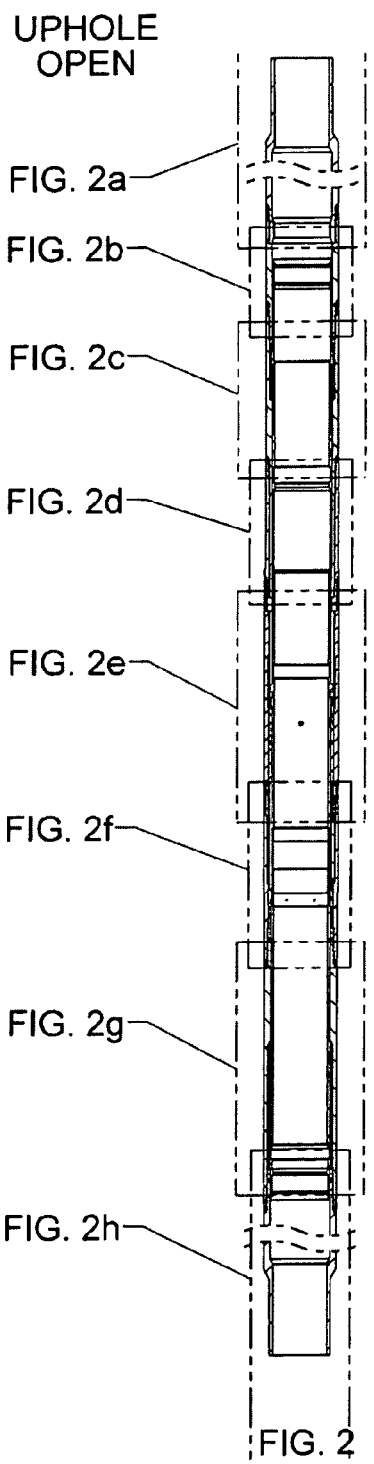
FIG. 2 is a composite drawing showing the segments in the following detailed drawings of the valve in the open position.
Figure 3:
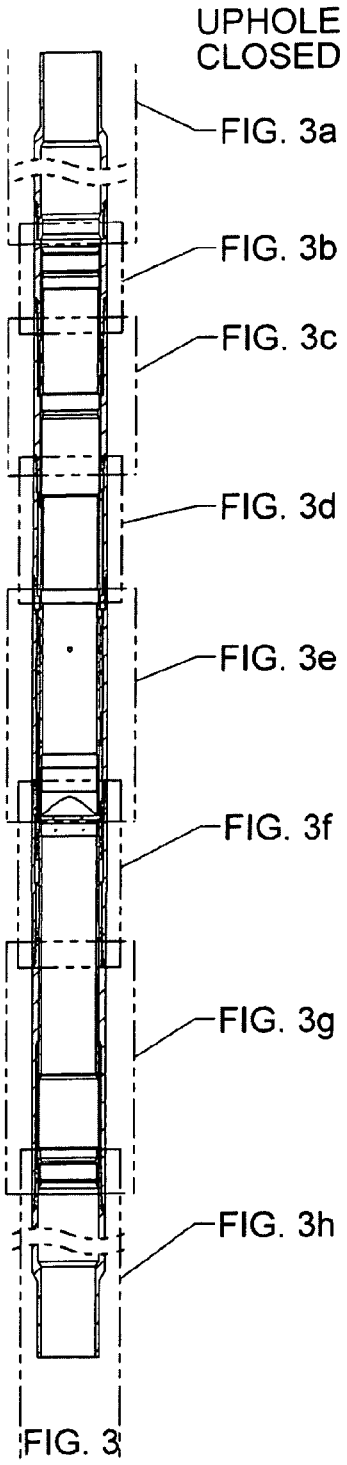
FIG. 3 is a composite drawing showing the segments in the following detailed drawings of the valve in the closed position.

The MBIV assembly is illustrated in sectional views 2*a*-2*h* and 3*a*-3*h*. In FIG. 2, the valve is in the open position and in FIG. 3 it is in the closed position Some parts of the valve assembly extend over multiple figures.

Figure 2A:
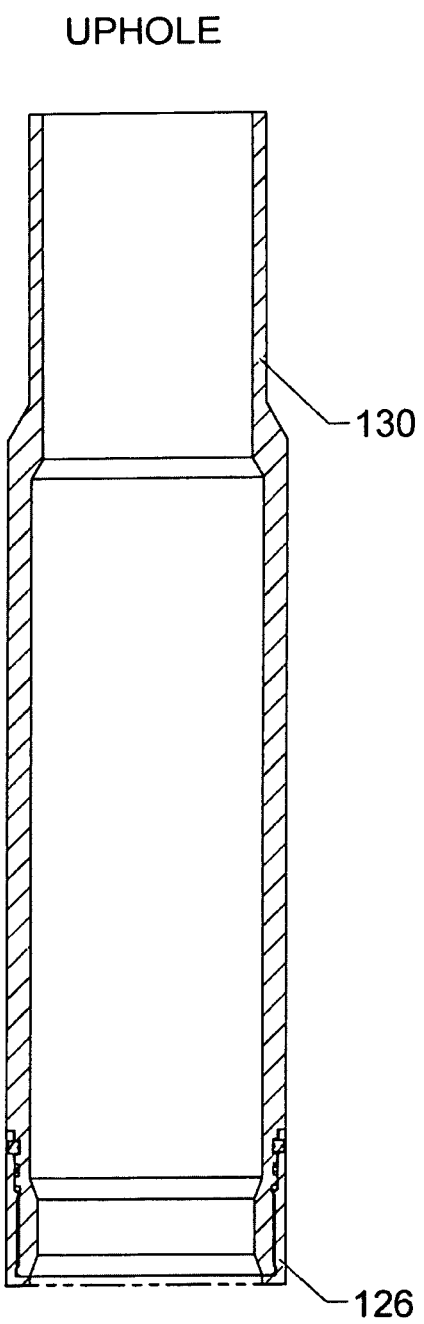
FIGS. 2*a*-2*h* illustrate the valve disclosed herein in the open position.

FIG. 2*a* shows upper connection housing 130. Threads on upper connection housing 130 are adapted for joining to the casing in which the MBIV 20 is to be employed.

Figure 2B:
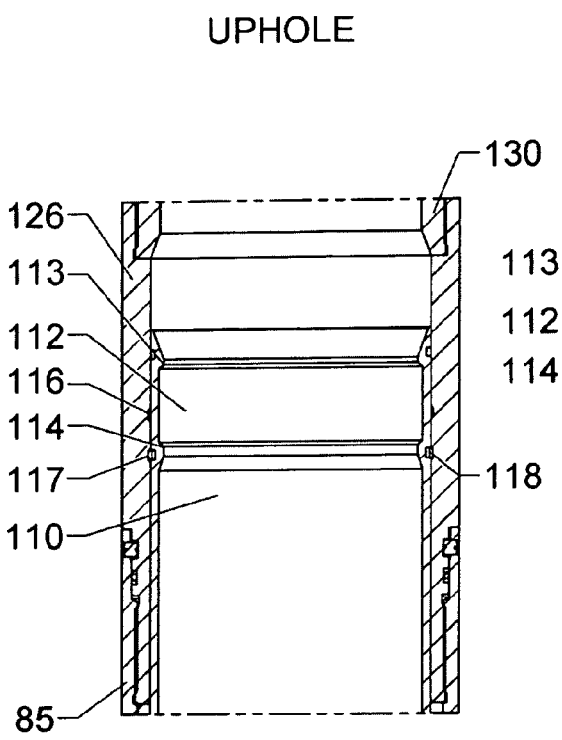

FIG. 2*b* shows upper connection housing 130 which is joined to the uphole end of upper release housing 126. Upper release housing 126 is joined to intermediate housing 85 on its downhole end. This joining may be a threaded connection, as shown. Upper locking sleeve 110 is placed in upper release housing 126. Upper locking sleeve split ring 118 is expanded into upper release housing downhole split ring groove 117. Upper release housing uphole split ring groove 116 is also shown. FIG. 2*b* also shows upper locking sleeve actuation groove 112 with upper locking sleeve actuation groove uphole chamfer 113 and upper locking sleeve actuation groove downhole chamfer 114, which are used for locking the tool.

Figure 2C:
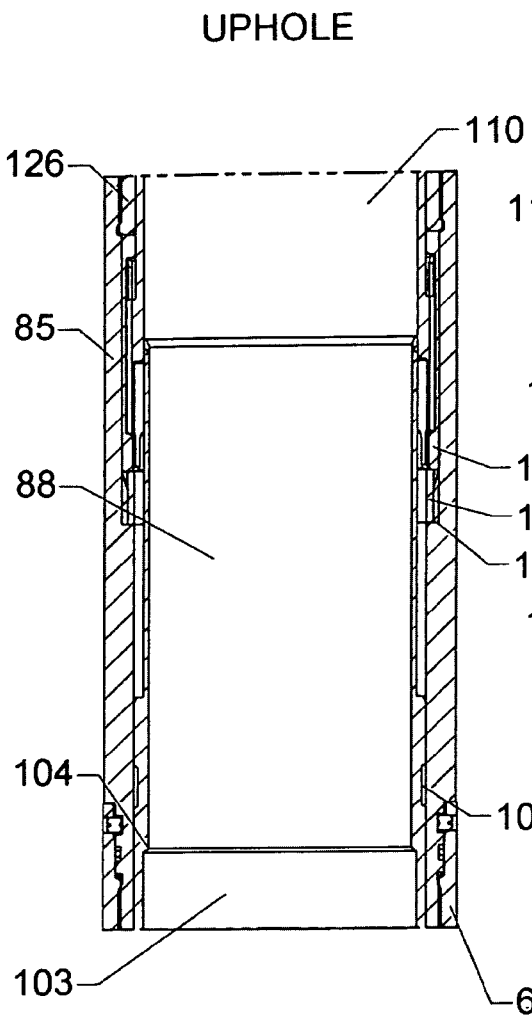

FIG. 2*c* shows intermediate housing 85 connected to the upper release housing 126 on its uphole end and to spline housing 68 on its downhole end. This joining may be a threaded connection. Upper locking sleeve 110 and upper locking tube 88 are located inside intermediate housing 85. Upper locking fingers 120 are shown in the unlocked position on the outside diameter of upper locking tube 88. Upper locking groove 102, located on the outside diameter of upper locking tube 88, is also shown. FIG. 2*c* also shows the upper locking tube actuation groove 103 and the upper locking tube actuation groove uphole chamfer 104 located on the inside diameter of the upper locking tube 88. Upper positioning ring 122 shouldering on the intermediate housing shoulder limit 125 is also shown.

Figure 2D:
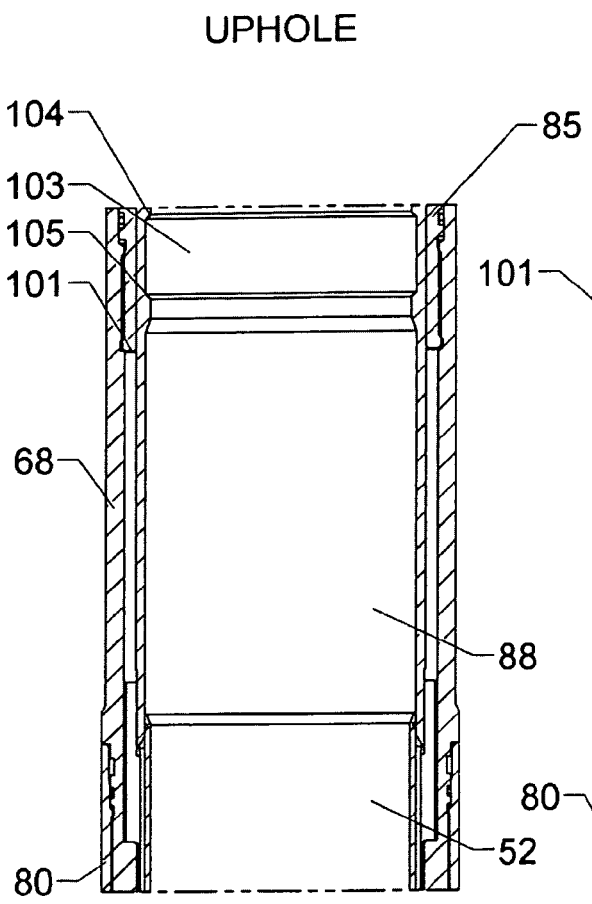

FIG. 2*d* shows spline housing 68 connected to intermediate housing 85 on its uphole end and carrier sleeve housing 80 on its downhole end. This joining may be a threaded connection. Upper locking tube actuation groove downhole chamfer 105 is located on the inside diameter of upper locking tube 88 and protective sleeve 52 is located inside the spline housing 68. Upper locking tube 88 with intermediate housing shoulder limit A 101 is also shown.

Figure 2E:
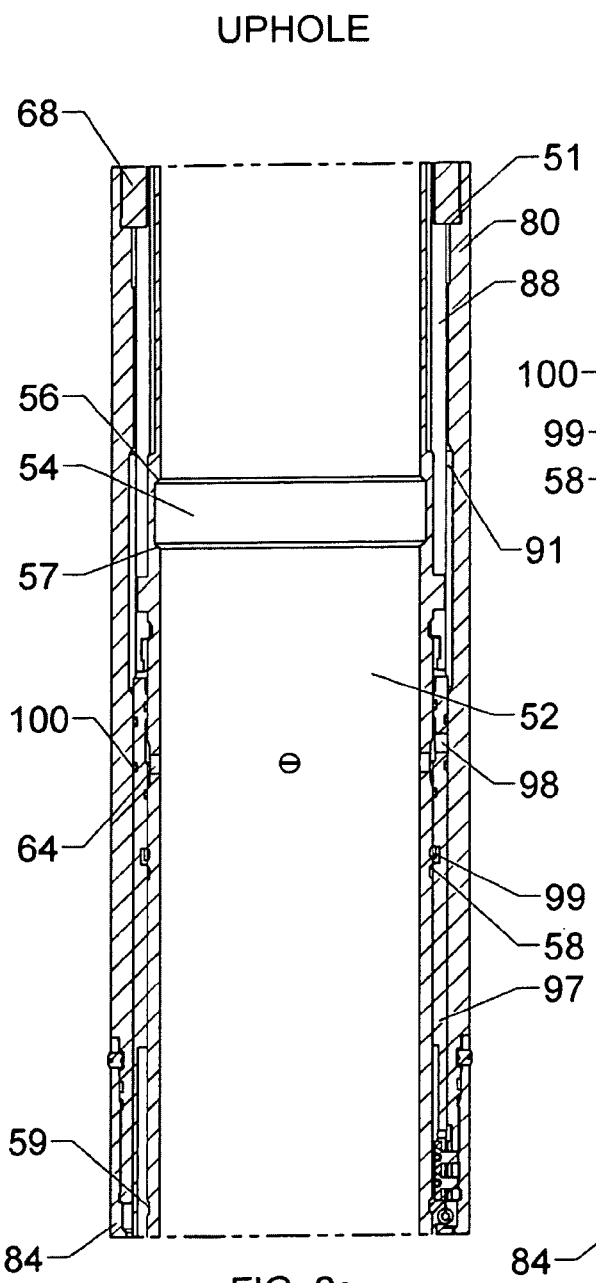

FIG. 2*e* shows carrier sleeve housing 80 connected to spline housing 68 on its uphole end and to the "Wedgelock" housing 84 on its downhole end. This joining may be a threaded connection. Carrier sleeve housing 80 contains the connection between upper locking tube 88 and valve body 97. Shown also are protective sleeve shoulder limit 51 of protective sleeve 52 to spline housing 68, and a pressure equalization configuration consisting of protective sleeve 52, protective sleeve pressure equalization ports 64, valve body pressure equalization ports 98, carrier housing pressure equalization cavity 91 and valve body pressure equalization seal 100. Shown also is protective sleeve actuation groove 54, protective sleeve actuation groove uphole chamfer 56 and protective sleeve actuation groove downhole chamfer 57. Valve body split ring 99 is placed on the inside diameter of valve body 97 and may be expanded into protective sleeve uphole split ring groove 58. Protective sleeve downhole split ring groove 59 is also shown.

The term "Wedgelock" is used herein to identify the sealing element of the valve. It preferably has two curved surfaces, and may be formed by machining curved surfaces from round stock, the surfaces being separated by the selected thickness of the valve element, to form a "saddle-like" shape. The thickness is selected according to the pressure differential expected across the valve.

Figure 2F:
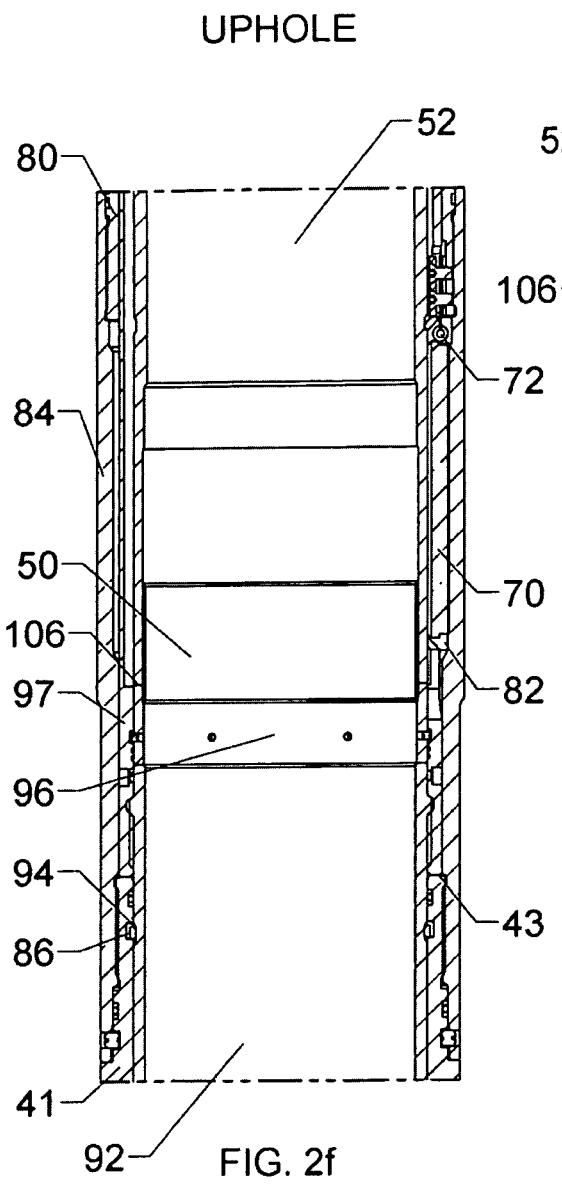

FIG. 2*f* shows Wedgelock housing 84 connected to carrier sleeve housing 80 on its uphole end and to lower locking housing 41 on its downhole end. Wedgelock 70 and hinge assembly 72, shown in the open position, is covered by protective sleeve 52 and debris sleeve 50 forming Wedgelock pocket 82. Any joining connection may be threaded. Shown also are valve body 97 with lower valve seat 96, lower lock housing split ring 86, lower locking tube open split ring groove 94, valve body shoulder limit 106 and lower lock housing shoulder limit 43.

Figure 2G:
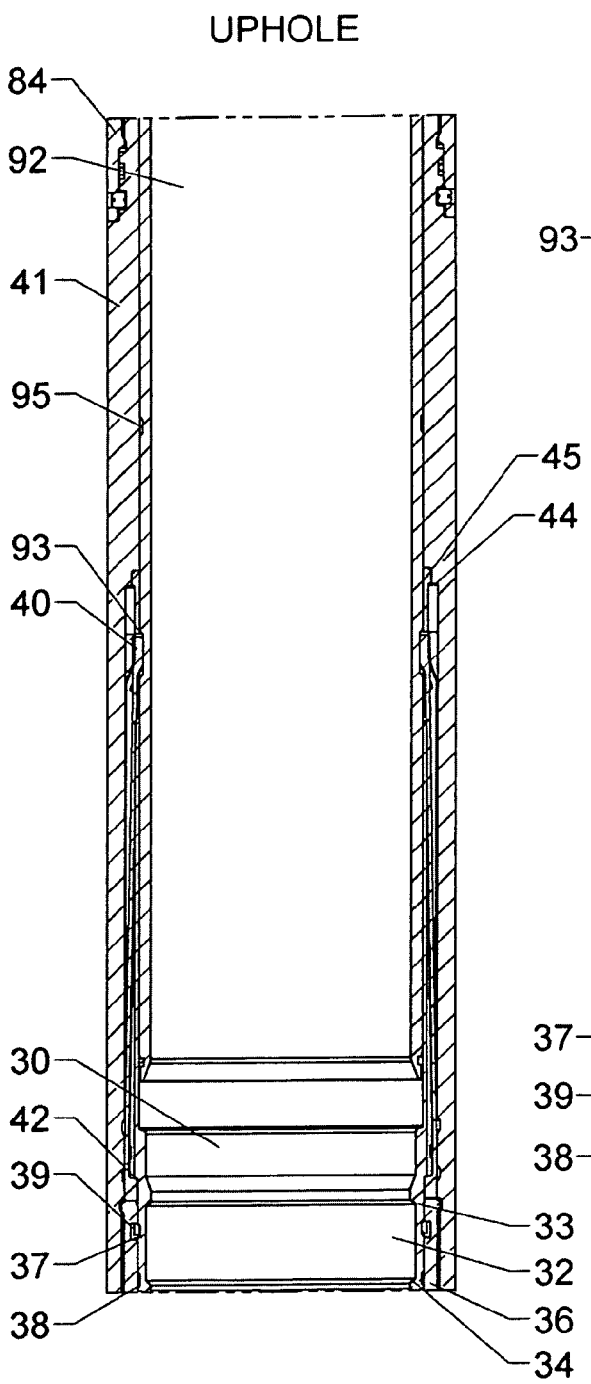

FIG. 2*g* shows lower lock housing 41 joined to the Wedgelock housing 84 on its uphole end and to lower connection housing 36 on its downhole end. This joining may be a threaded connection. Lower locking tube 92 also contains the lower locking sleeve 30 with open locking groove 93 on its outside diameter, lower locking fingers 40 and lower positioning ring 45. FIG. 2*g* also shows lower connection housing split ring 39, positioned in lower connection housing 36, expanding into lower connection housing open split ring groove 37 and lower connection housing closed split ring groove 38. Shown also are lower locking tube closed split ring groove 95, lower locking sleeve actuation groove 32, lower locking sleeve actuation groove downhole chamfer 34 lower locking sleeve actuation groove uphole chamfer 33, lower lock housing shoulder limit 44 and lower connection housing shoulder limit 42.

Figure 2H:
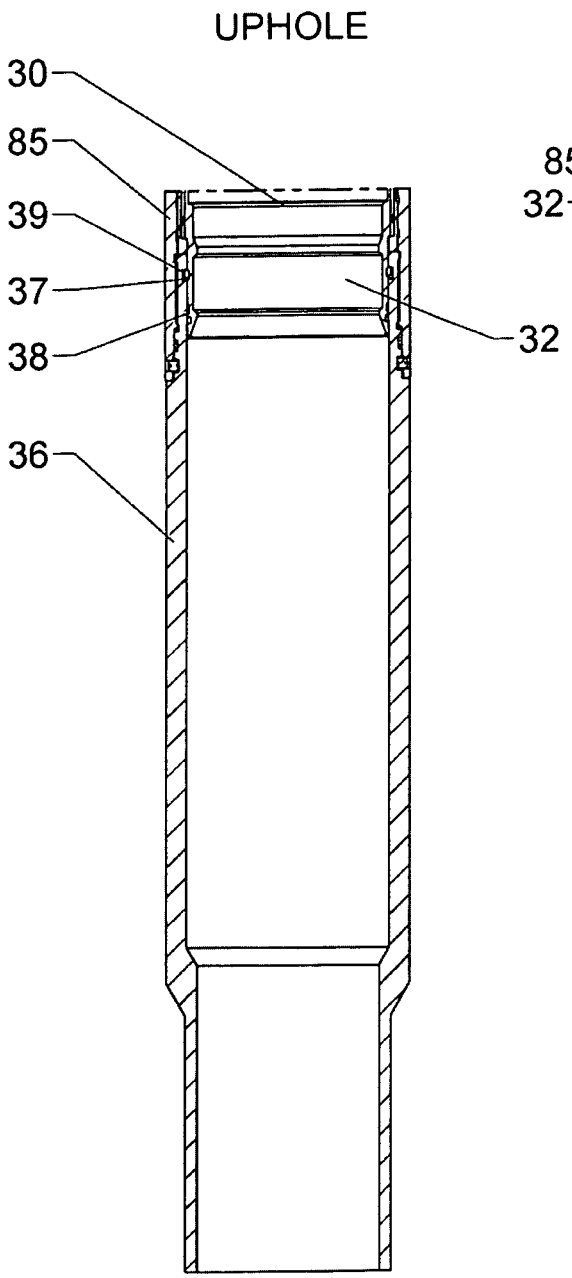

FIG. 2*h* shows intermediate housing 85 connected to lower connection housing 36 on its downhole end. This connection may be a threaded connection. FIG. 2*h* also shows the lower end of the lower locking sleeve 30 with the lower locking sleeve actuating groove 32.

Figure 3A:
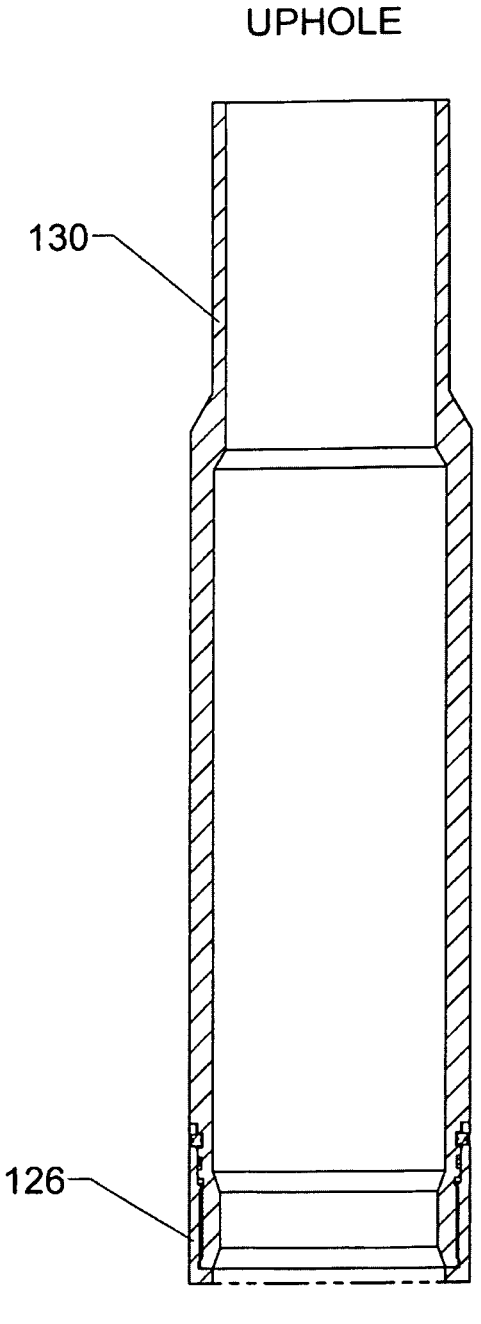
FIGS. 3*a*-3*h* illustrate the valve disclosed herein in the closed position.

FIG. 3*a* shows upper connection housing 130. Threads on upper connection housing 130 are adapted for joining to the casing in which MBIV 20 is to be employed.

Figure 3B:
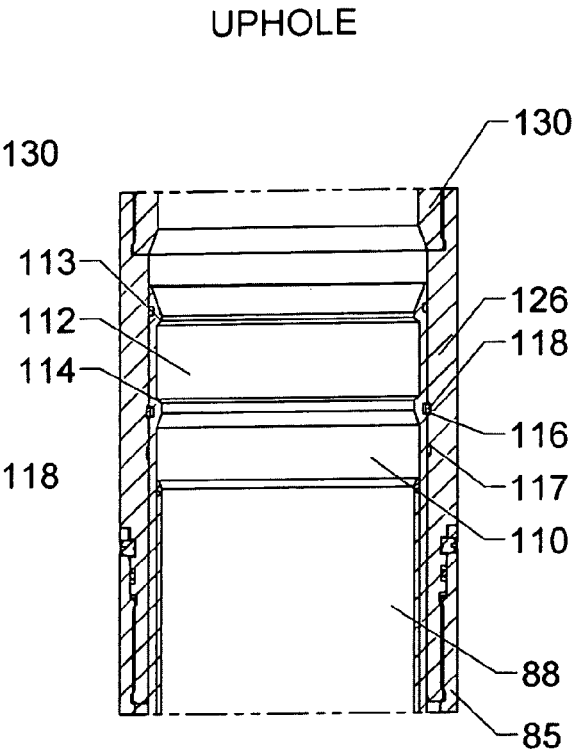

FIG. 3*b* shows upper connection housing 130, which is joined to upper release housing 126 on its uphole end and to intermediate housing 85 on its downhole end. This joining may be a threaded connection as shown. Upper locking sleeve 110 is located in upper release housing 126. Upper locking sleeve split ring 118 is expanded into upper release housing uphole split ring groove 116. Upper release housing downhole split ring groove 117 is also shown. FIG. 3*b* also shows upper locking sleeve actuation groove 112 with upper locking sleeve actuation groove uphole chamfer 113 and upper locking sleeve actuation groove downhole chamfer 114 used for locking the tool. In the closed position upper locking tube 88 is shown.

Figure 3C:
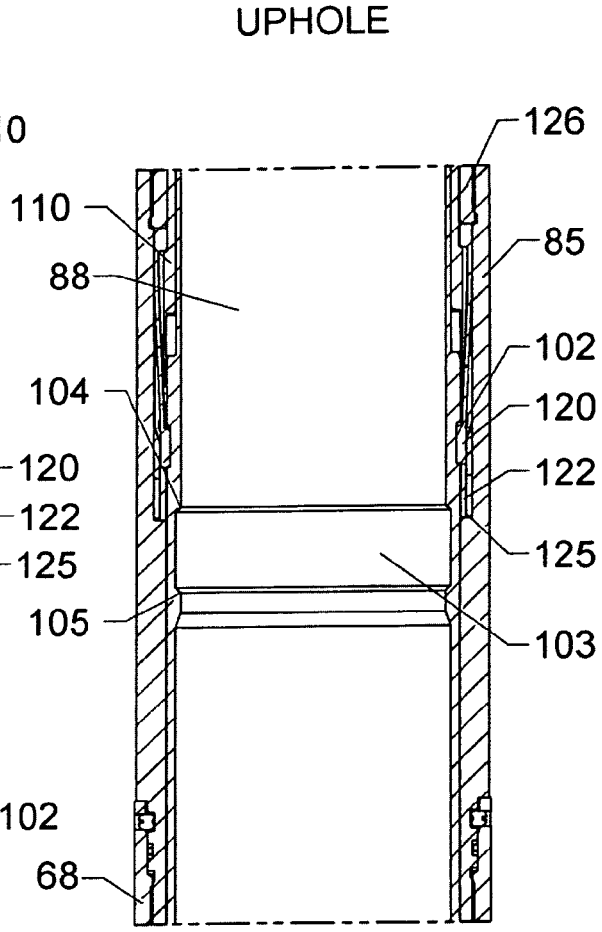

FIG. 3*c* shows intermediate housing 85 connected to the upper release housing 126 on its uphole end and to spline housing 68 on its downhole end. This joining may be a threaded connection. Upper locking sleeve 110 and the upper locking tube 88 are located inside intermediate housing 85. Upper locking fingers 120 are shown in the locked position on the outside diameter of upper locking tube 88. Upper locking groove 102 located on the outside diameter of upper locking tube 88 is also shown. FIG. 3*c* also shows upper locking tube actuation groove 103, upper locking tube actuation groove uphole chamfer 104 and upper locking tube actuation groove downhole chamfer 105 located on the inside diameter of upper locking tube 88. Upper positioning ring 122 shouldering on intermediate housing shoulder limit 125 is also shown.

Figure 3D:
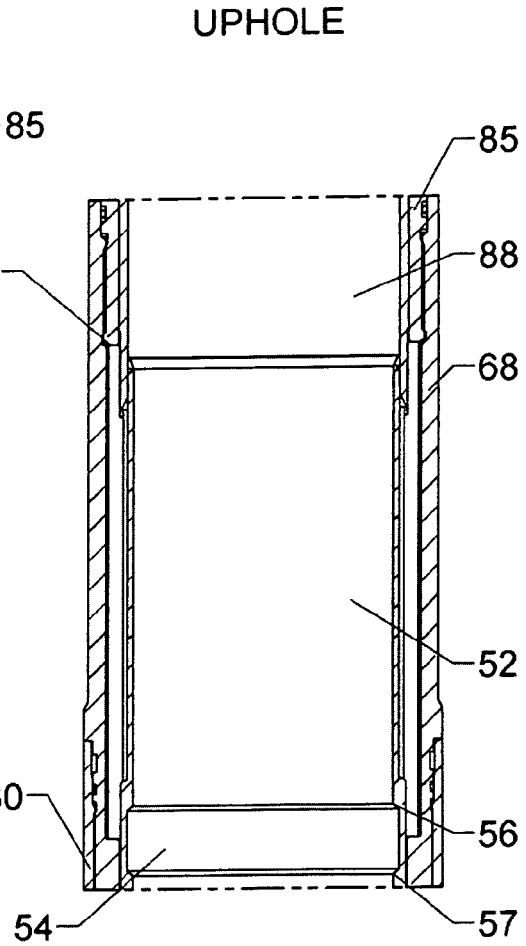

FIG. 3*d* shows spline housing 68 connected to intermediate housing 85 on the uphole end and carrier sleeve housing 80 on the downhole end. This joining may be a threaded connection. Protective sleeve 52 is located inside intermediate housing 85. Shown also is upper locking tube 88 with intermediate housing shoulder limit 101, protective sleeve 52 with protective sleeve actuation groove 54, protective sleeve actuation groove uphole chamfer 56 and protective sleeve actuation groove downhole chamfer 57.

Figure 3E:
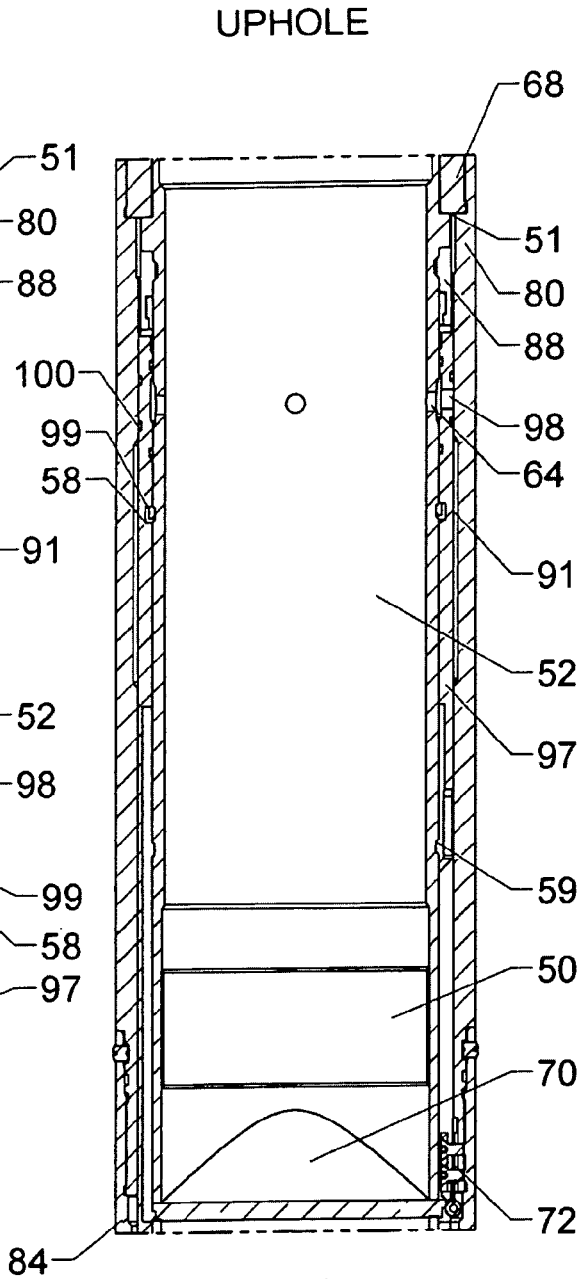

FIG. 3*e* shows carrier sleeve housing 80 as shown connected to spline housing 68 on its uphole end and to wedgelock housing 84 on its downhole end. This joining may be a threaded connection. Carrier sleeve housing 80 contains the connection between the upper lock tube 88 and the valve body 97. Shown also are protective sleeve shoulder limit 51 of protective sleeve 52 connected to spline housing 68, an overpressure equalization arrangement consisting of protective sleeve pressure equalization polls 64, valve body pressure equalization ports 98, carrier housing pressure equalization cavity 91, and valve body pressure equalization seal 100. The lower portion of FIG. 3*e* shows debris sleeve 50, hinge assembly 72 and "Wedgelock" 70 in the closed position. Valve body split ring 99, located on the inside of valve body 97, and expands into the protective sleeve uphole split ring groove 58. Protective sleeve downhole split ring groove 59 is also shown.

Figure 3F:
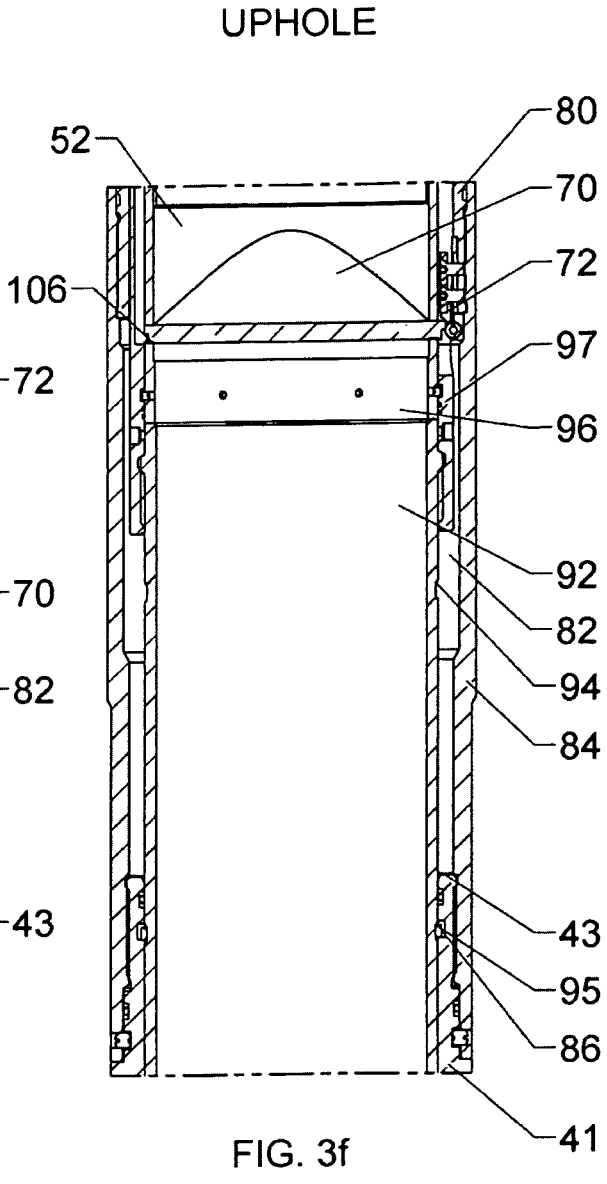

FIG. 3*f* shows Wedgelock housing 84 connected to carrier sleeve housing 80 on its uphole end and to lower locking housing 41 on its downhole end Wedgelock 70 and hinge assembly 72 are shown in the closed position. Any joining connection may be threaded. Shown also is valve body 97 with lower valve seat 96, lower lock housing split ring 86, lower locking tube open split ring groove 94, lower locking tube closed split ring groove 95, lower lock housing shoulder limit 43, valve body shoulder limit 106 and lower locking tube 92.

Figure 3G:
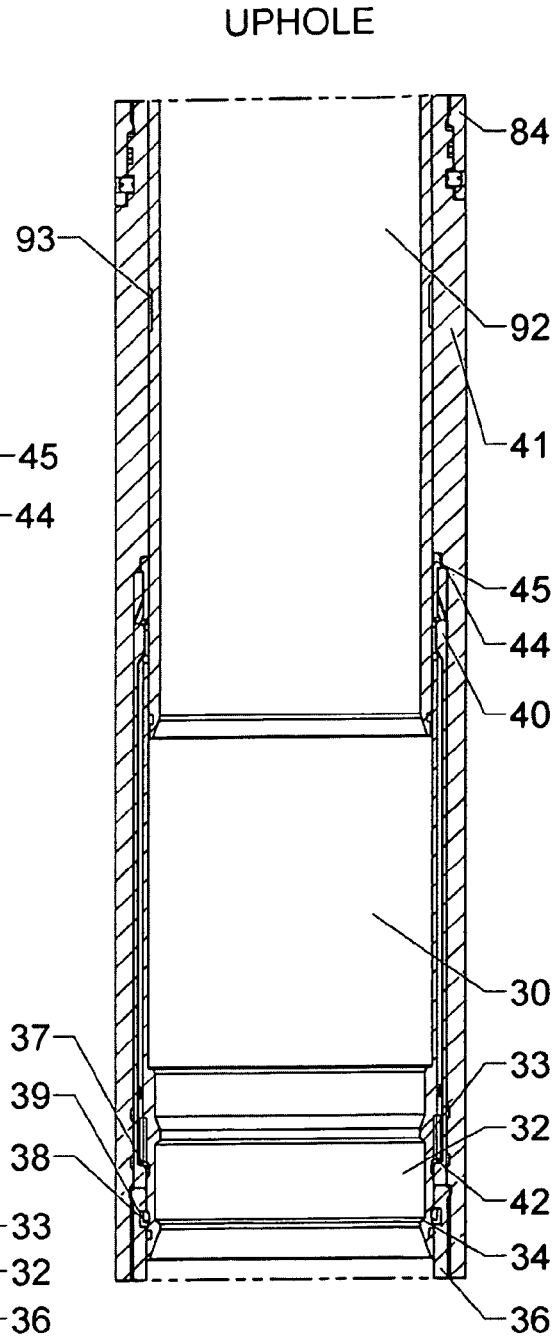

FIG. 3*g* shows lower lock housing 41 joined to the Wedgelock housing 84 on the uphole end and to lower connection housing 36 on it downhole end. This joining may be a threaded connection. Lower locking tube 92 also contains lower locking sleeve 30 with open locking groove 93 on its outside diameter, lower locking fingers 40 and lower positioning ring 45. FIG. 3*g* also shows lower connection housing split ring 39, positioned in the lower connection housing 36, expanding into lower connection housing closed split ring groove 38 lower connection housing open split ring groove 37. Shown also are lower lock housing shoulder limit 44, lower connection housing shoulder limit 42, lower locking sleeve actuation groove 32 with lower locking sleeve actuation groove downhole chamfer 34 and lower locking sleeve actuation groove uphole chamfer 33.

Figure 3H:
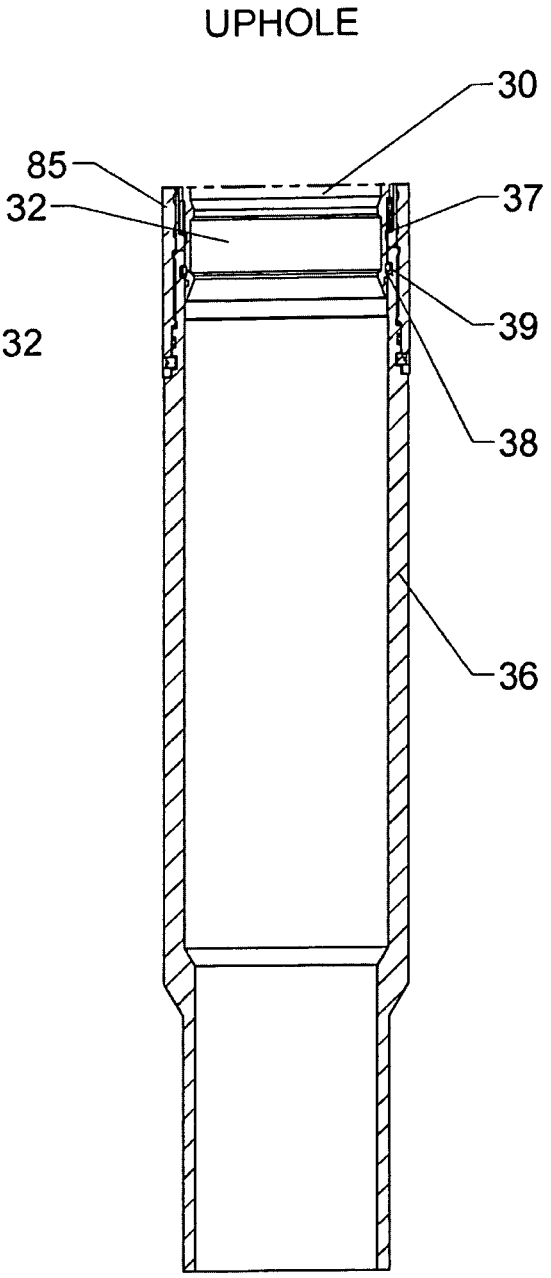

FIG. 3*h* shows intermediate housing 85 connected to the lower connection housing 36 on its downhole end. This connection may be a threaded connection. FIG. 3*h* also shows the lower end of lower locking sleeve 30 with lower locking sleeve actuating groove 32.

Figure 4:
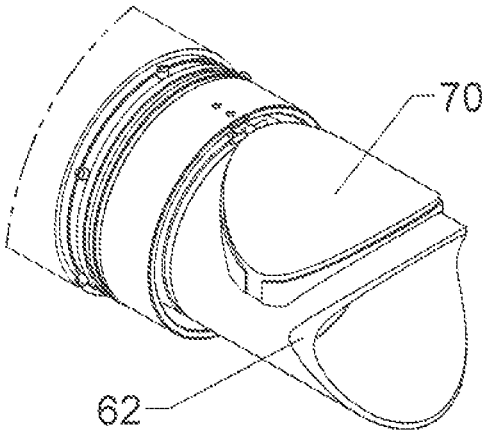
FIG. 4 is an isometric view of the "Wedgelock" in the open position.

FIG. 4 shows an isometric view of Wedgelock 70 in the open position with upper valve seat area 62.

Figure 5:
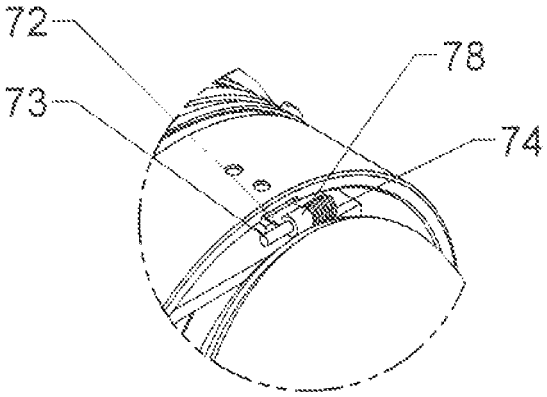
FIG. 5 is an isometric view of the Wedgelock hinge assembly.

FIG. 5 shows an isometric view of hinge assembly 72 with springs 74, sliding hinge 78 and a hinge pin 73.

Figure 6:
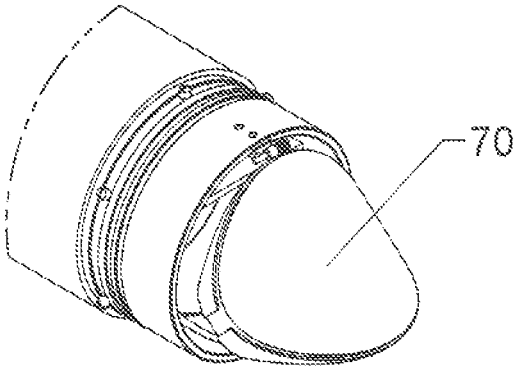
FIG. 6 is an isometric view of the Wedgelock in the partially closed position.

FIG. 6 shows an isometric view of Wedgelock 70 in the closing position.

Figure 7:
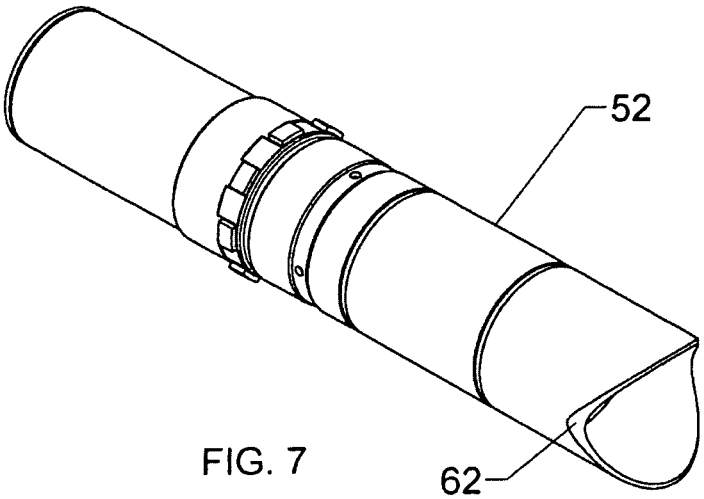
FIG. 7 is an isometric view of a protective sleeve with an upper valve seat area.

FIG. 7 shows an isometric view of protective sleeve 52 and upper valve seat area 62.

Figure 8:
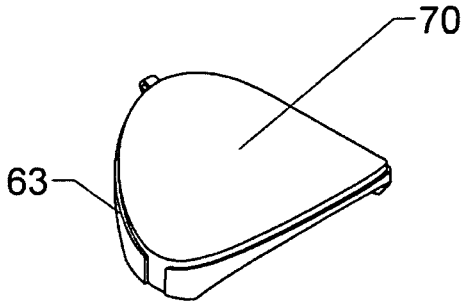
FIG. 8 is an isometric view of the Wedgelock.

FIG. 8 shows an isometric view of Wedgelock 70 with guide pin track 63.

Figure 9:
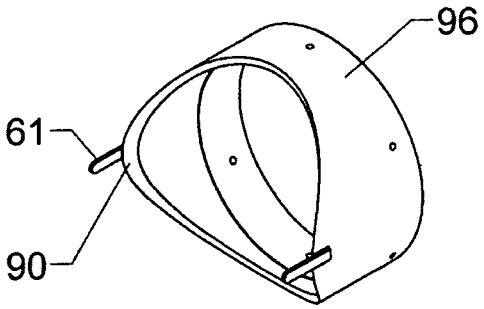
FIG. 9 is an isometric view of a lower valve seat with valve seat area.

FIG. 9 shows an isometric view of lower valve seat 96 with lower valve seat area 90 and guide pins 61.

Figure 10:
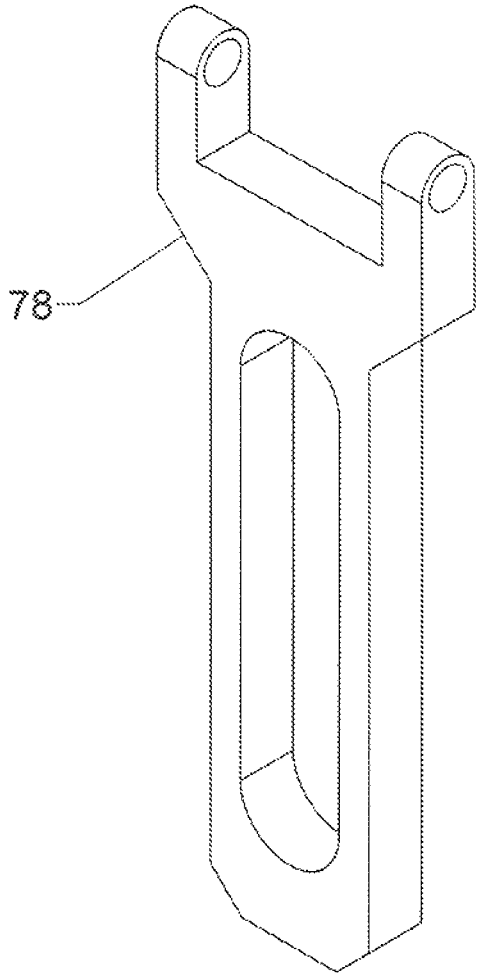
FIG. 10 is an isometric view of a hinge plate for the Wedgelock.

FIG. 10 shows an isometric view of sliding hinge 78.

Figure 11:
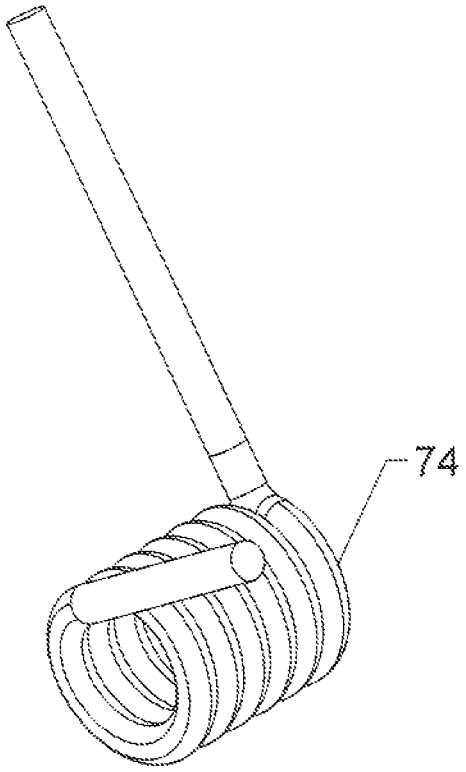
FIG. 11 is an isometric view of a spring for the Wedgelock.

FIG. 11 shows an isometric view of a spring 74.

Figure 12:
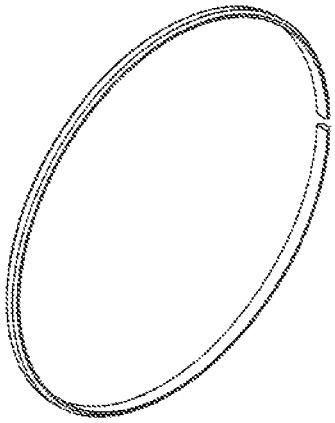
FIG. 12 is an isometric view of a split ring of the valve assembly.

FIG. 12 shows an isometric view of a typical split ring.

Figure 13:
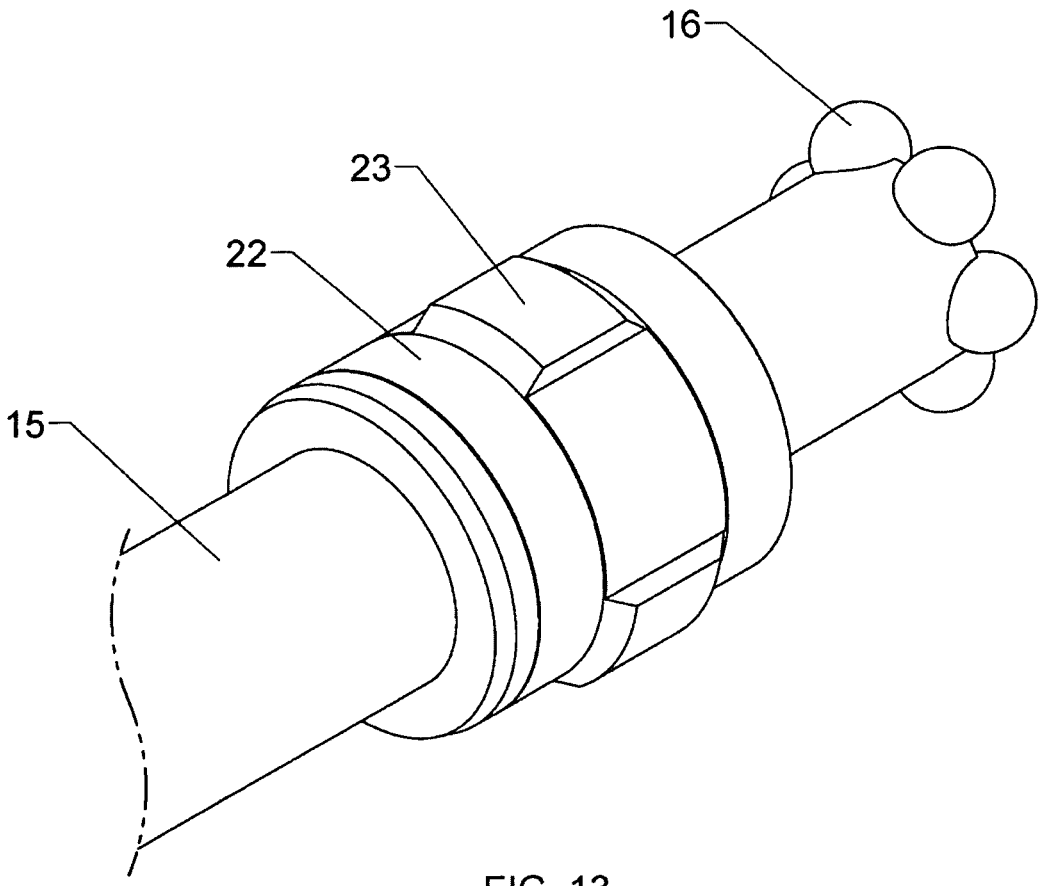
FIG. 13 is an isometric view of the spring-loaded actuation assembly on the bottom-hole assembly.

FIG. 13 shows an actuation assembly that may be mounted on BHA 22 and drill pipe 15 to actuate the valve mechanisms when drill pipe 15 and drill bit 16 move through the valve. Retractable, spring-loaded dogs 23 are adapted to enter actuation grooves in the valve that are identified below, which applies forces to move the various elements of the valve.

To move MBIV 20 from the open position to a closed position after drill bit 16, FIG. 1, is raised to a location below the MBIV 20, BHA 22 moves through lower locking sleeve 30, (FIG. 2*g, h*) which will permit spring-loaded dogs 23 mounted on the bottom-hole assembly (BHA) 22 to expand into lower locking sleeve actuation groove 32, which will then move lower locking sleeve 30 (FIG. 2*g, h*) uphole. When force F exceeds a predetermined force F1, set by geometry of lower connection housing open split ring groove 37 and geometry of lower connection housing split ring 39 in lower connection housing 36, disengages from the lower connection housing open split ring groove 37, then lower locking sleeve 30 with connection housing split ring 39 moves uphole and engages with the lower connection housing closed split ring groove 38. This unlocks lower locking fingers 40 from open locking groove 93 located on the outside of lower locking tube 92, which enables lower locking tube 92 to freely move uphole. Lower locking tube 92 may be considered to be part of an inner locking tube assembly that consists of lower locking tube 92, lower valve seat 96, valve body 97 and upper locking tube 88. As drill bit 16 continues to travel uphole, spring-loaded dogs 23 on the BHA 22 exert an increasing force F onto lower locking sleeve actuation groove uphole chamfer 33 of lower locking sleeve actuation groove 32. As force F continues to increase and exceeds a predetermined force F2, spring-loaded dogs 23 on BHA 22 will collapse and disengage from the lower locking sleeve actuation groove 32.

As drill bit 16 travels uphole, spring-loaded dogs 23 on BHA 22 will exert a force, engage with inside diameter of debris sleeve 50 and move debris sleeve 50 (FIG. 2*f*) uphole. The drill string continues to move uphole until spring loaded dogs 23 on BHA 22 expand into protective sleeve actuation groove 54 (FIG. 2*e*) located on the protective sleeve 52. Continuing the uphole movement, valve body split ring 99 may engage with split ring grooves to allow controlled movements of protective sleeve 52. This will move protective sleeve 52 uphole with drill bit 16 until protective sleeve 52 reaches protective sleeve shoulder limit 51 in spine housing 68. As drill bit 16 continues to travel uphole, spring-loaded dogs 23 on BHA 22 exert a force F onto protective sleeve actuation groove uphole chamfer 56 until spring-loaded dogs 23 on the BHA 22 exceed a predetermined limit force F3, collapsing and disengaging spring-loaded dogs 23 on BHA 22 from protective sleeve actuation groove 54.

The movement of protective sleeve 52 uphole will open Wedgelock pocket 82, which provided space for Wedgelock 70 in the open position. As this area becomes exposed, Wedgelock 70 is moved into the valve bore area by a force that may be generated by springs 74 mounted on one or more floating hinge assemblies 72.

As drill bit 16 continues to travel uphole, spring-loaded dogs 23 on BHA 22 move to and expand into upper locking tube actuation groove 103 (FIG. 2*d*). Force F is exerted by lower lock housing split ring 86, located inside lower lock housing 41, onto lower locking tube open split ring groove 94 in lower locking tube 92 until it exceeds a predetermined force F4 and disengages. Upper locking tube 88 moves uphole with drill bit 16. Guide pins 61 (FIG. 9) engage with guide pin track 63 (FIG. 8) located on the downhole side of Wedgelock 70, which positions lower valve seat area 90 with Wedgelock 70 into upper valve seat area 62 (FIGS. 4, 7), located on protective sleeve 52 to establish bi-directional seating. Simultaneously, valve body split ring 99 expands into protective sleeve uphole split ring groove 58. Wedgelock 70 is mounted on axially floating hinge assembly 72.

As drill bit 16 travels uphole, spring-loaded dogs 23 on the BHA 22 exerts a force F onto upper locking tube actuation groove uphole chamfer 104 (FIG. 2*c*), located on upper locking tube 88 until it disengages from upper locking tube actuation groove 103.

As drill bit 16 continues to travel further uphole, spring-loaded dogs 23 on the BHA 22 move to and expand into upper locking sleeve actuation groove 112 located on upper locking sleeve 110 (FIG. 2*b*) Upper locking sleeve 110 moves uphole with drill bit 16 until a force F from upper locking sleeve split ring 118 exceeds a predetermined limit force F6 and disengages from upper release housing downhole split ring groove 117 located on upper release housing 126. As movement continues further uphole, upper locking sleeve split ring 118 will expand into upper release housing split ring groove 116 located on upper release housing 126. Simultaneously, upper locking sleeve 110 moves over upper locking fingers 120 and forces upper locking fingers 120 to collapse into upper locking groove 102 (FIG. 2*c*) located on upper locking tube 88. This locks MBIV 20 into the closed position.

The spacing, S, between the bottom of drill bit 16 and spring-loaded dogs 23 is a determining factor in the overall length of MBIV 20. The spacing between Wedgelock 70 and protective sleeve actuation groove 54 must be greater than the spacing S.

To move MBIV 20 from a closed position to an open position after drill bit 16, FIG. 1, is lowered to a location above the MBIV 20, drill bit 16 moves into upper locking sleeve 110. spring-loaded dogs 23 mounted on BHA 22 will expand into upper locking sleeve actuation groove 112 (FIG. 3*b*), moving the upper locking sleeve 110 downhole. Upper locking sleeve split ring 118, located in upper locking sleeve 110, disengages from upper release housing uphole split ring groove 116 and expands into upper release housing downhole split ring groove 117. As upper locking sleeve 110 is guided downhole, it disengages upper locking fingers 120 from upper locking groove 102. This unlocks MBIV 20 from the closed position.

When upper locking sleeve 110 reaches the intermediate housing shoulder limit B 125 (FIG. 3*c*), a force F, is exerted by spring-loaded dogs 23 mounted on BHA 22 on upper locking sleeve actuation groove downhole chamfer 114. When force F exceeds a predetermined force F8, spring-loaded dogs 23 on BHA 22 then collapse and disengage from upper locking sleeve actuation groove 112 and continue to travel downhole.

As actuation assembly on the BHA 22 travels downhole, it will expand into upper lock tube actuation groove 103 and start to move upper locking tube 88 downhole. When valve body equalization seal 100 shifts into the carrier housing pressure equalization cavity 91, downhole pressure is then released into valve body pressure equalization port 98. The excess pressure is discharged through the protective sleeve pressure equalization port 64 into the well bore uphole of Wedgelock 70. The pressure on both sides of Wedgelock 70 is now equalized for safe MBIV 20 operation. Increasing the actuation force F will disengage lower lock housing split ring 86 from lower locking tube closed split ring groove 95. Lower lock housing split ring 86 will then expand into the lower locking tube open split ring groove 94. During this operation, lower valve seat 96 moves away from Wedgelock 70. Actuation tool assembly on the BHA 22 continues to travel downhole until valve body 97 reaches its lower lock housing shoulder limit 43. A force F is then exerted onto the upper locking tube actuation groove downhole chamfer 105. When force F exceeds predetermined force F9 spring-loaded dogs 23 on the BHA 22 collapse and disengage from upper locking tube actuation groove 103.

As actuation assembly on BHA 22 travels downhole, it will expand into protective sleeve actuation groove 54 located in protective sleeve 52. As protective sleeve 52 begins to move downhole, valve body split ring 99 will disengage from protective sleeve downhole split ring groove 59 due to exceeding a force F10. Protective sleeve 52 will then continue to move downhole and expand into protective sleeve uphole split ring groove 58. During this movement downhole, protective sleeve 52 will drive Wedgelock 70 from upper valve seat area 62. Wedgelock 70 will shift and rotate from the closed position into the open position. After protective sleeve 52 reaches valve body shoulder limit 106 Wedgelock 70 will be contained in Wedgelock pocket 82 and will be isolated from the flow path by protective sleeve 52. Actuation tool assembly on BHA 22 exerts a force F onto the protective sleeve actuation groove downhole chamfer 57 until it exceeds a predetermined force F11, collapsing and disengaging from the protective sleeve actuation groove 54.

Spring-loaded dogs 23 on BHA 22 continue to travel downhole engaging and moving debris sleeve 50 downhole until it reaches valve body shoulder limit 106 in order to cover the downhole end of protective sleeve 52.

As spring-loaded dogs 23 on BHA 22 continue to travel further downhole, they expand into lower lock sleeve actuation groove 32 located in the lower lock sleeve 30. As lower lock sleeve 30 moves downhole, a force F is exerted onto the lower connection housing split ring 39 until it disengages from lower connection housing closed split ring groove 38 and expands into the lower connection housing open split ring groove 37. As lower lock sleeve 30 moves downhole it slides over the lower locking fingers 40 and forces them to collapse into open locking groove 93. Lower lock sleeve 30 moves downhole until it comes in contact with lower connection housing shoulder limit 42. Spring-loaded dogs 23 on BHA 22 start to exert a force F onto lower locking sleeve actuation groove downhole chamfer 34. When force F exceeds a predetermined limit F12, spring-loaded dogs 23 on BHA 22 collapse and disengage from lower locking sleeve actuation groove 32. The MBIV 20 is now locked into the open position.

The actuation mechanism on the drill pipe that moves the elements of the valve as the drill pipe and drill bit are moved in and out of the wellbore has been illustrated here as spring-loaded dogs 23 on the BHA 22, but it should be understood that the invention disclosed is not limited to a particular actuation mechanism. For example, the actuation mechanism on the drill pipe that exerts a force to operate the valve may be other spring-loaded or pressure-loaded mechanical arrangements or it may be hydraulically or electrically powered by other apparatus placed on the drill pipe 15 or BHA 22. A signal to operate the valve actuation mechanism or to turn off the valve actuation mechanism may be programmed into apparatus placed on the drill pipe or may be transmitted from the surface.

Although the present invention has been described with respect to specific details, it is not intended that such details should be regarded as limitations on the scope of the invention, except as and to the extent that they are included in the accompanying claims.

We claim:

1. A valve for isolating pressure in a tubular located within a portion of an oil or gas well comprising:

a housing adapted to be joined to the tubular;

a valve element having an uphole valve surface on a top portion thereof and a downhole valve surface on a bottom surface thereof;

a hinge mechanism for supporting the valve element;

a first valve seat engaging the uphole valve surface of the valve element in a closed position, wherein the first valve seat is movable relative to the housing;

a second valve seat axially movable with respect to the housing and positioned within the housing and engaging the downhole valve surface of the valve element in the closed position, thereby sealing fluid pressure in both flow directions;

a valve body positioned within the housing and having a portion extending beyond both downhole and uphole of the valve element when the valve is in a closed position; and the valve body being fixedly attached to the second movable valve seat and axially movable to move the second movable valve seat into contact with the downhole valve surface on the valve element.

2. The valve according to claim 1 further including a protective sleeve mounted for axial movement within the housing and completely covering the valve element in the open position.

3. The valve according to claim 2 where the first valve seat is located at an end of the protective sleeve.

4. The valve according to claim 1 further including an upper locking tube connected to the valve body.

5. The valve according to claim 4 further including an upper locking sleeve and a lower locking sleeve.

6. The valve of claim 1 wherein the tubular is a casing in a well.

7. The valve of claim 4 further comprising a by-pass mechanism to equalize excess pressure across the valve when the valve element is in the closed position.

8. The valve of claim 1 further comprising a debris sleeve.

9. The valve of claim 4 wherein the valve body is operatively coupled to the second movable valve seat via a lower locking tube.

10. The valve according to claim 1 further including a part to receive a force from an actuation assembly moving inside the valve so as to move the valve body, and the second movable valve seat.

11. A valve according to claim 10 wherein the actuation assembly comprises spring-loaded dogs on a drill pipe.

12. A valve according to claim 1 wherein the valve body comprises an annular tubular member surrounding the valve element.

13. A valve for isolating pressure in a tubular located within a portion of an oil or gas well comprising:

a housing adapted to be joined to the tubular;

a valve element having an uphole valve surface on a top portion thereof and a downhole valve surface on a bottom surface thereof;

a hinge mechanism for supporting the valve element;

a first valve seat engaging the uphole valve surface of the valve element in a closed position;

a second valve seat axially movable with respect to the housing and positioned within the housing and engaging the downhole valve surface of the valve element in the closed position, thereby sealing fluid pressure in both flow directions;

a valve body positioned within the housing and having a portion extending beyond both downhole and uphole of the valve element when the valve is in a closed position;

the valve body being fixedly attached to the second movable valve seat and axially movable to move the second movable valve seat into contact with the downhole valve surface on the valve element;

an upper locking tube connected to the valve body; and a lower locking tube operatively coupling the valve body to the second movable valve seat.

14. The valve of claim 13, further comprising a protective sleeve mounted for axial movement within the housing and completely covering the valve element in the open position.

15. The valve of claim 13, further comprising a by-pass mechanism to equalize excess pressure across the valve when the valve element is in the closed position.

16. The valve of claim 13, further including a part to receive a force from an actuation assembly moving inside the valve so as to move the valve body, and the second movable valve seat.

17. A valve of claim 16, wherein the actuation assembly comprises spring-loaded dogs on a drill pipe.

18. A valve of claim 13, wherein the valve body comprises an annular tubular member surrounding the valve element.

19. A valve for isolating pressure in a tubular located within a portion of an oil or gas well comprising:

a housing adapted to be joined to the tubular;

a valve element having an uphole valve surface on a top portion thereof and a downhole valve surface on a bottom surface thereof;

a hinge mechanism for supporting the valve element;

a first valve seat engaging the uphole valve surface of the valve element in a closed position, wherein the first valve seat is located at an end of a sleeve;

a second valve seat axially movable with respect to the housing and positioned within the housing and engaging the downhole valve surface of the valve element in the closed position, thereby sealing fluid pressure in both flow directions;

a valve body positioned within the housing and having a portion extending beyond both downhole and uphole of the valve element when the valve is in a closed position; and the valve body being fixedly attached to the second movable valve seat and axially movable to move the second movable valve seat into contact with the downhole valve surface on the valve element.

20. The valve of claim 19, wherein the valve body is operatively coupled to the second movable valve seat via a lower locking tube.

* * * * *